United States Patent [19]

Martin

[11] Patent Number: 4,815,144

[45] Date of Patent: Mar. 28, 1989

[54] COOLED HEADWEAR

[76] Inventor: Randolph L. Martin, 1540 N. Formosa Ave. #18, Hollywood, Calif. 90036

[21] Appl. No.: 57,307

[22] Filed: Jun. 4, 1987

[51] Int. Cl.[4] ..... A42B 1/18

[52] U.S. Cl. ..... 2/7; 2/171.2; 2/181; 2/199

[58] Field of Search ..... 2/7, 171.2, 171.3, 171, 2/199, 185 R, 12, 181

[56] References Cited

U.S. PATENT DOCUMENTS 2,247,971 7/1941 Snell ..... 2/12
3,029,438 4/1962 Henschel ..... 2/7
3,159,160 12/1964 Ullom ..... 2/171.2 X
4,130,902 12/1978 Mackenroth, III et al. .... 2/171.2 X
4,551,858 11/1985 Pasternack ..... 2/171.2 X

*Primary Examiner*—Peter Nerbun
*Attorney, Agent, or Firm*—Saul Epstein

[57] ABSTRACT

An improvement for a cap of the type which uses a cooling pouch which contains a freezable liquid or gel and inserted in the forehead area of the cap. The improvement consists of segmenting the cooling pouch so that it can easily be made to conform to the shape of a wearer's forehead and a plastic drain channel which catches and retains any condensate which may form on the cooling pouch during periods of high humidity.

3 Claims, 1 Drawing Sheet

Fig. 1.
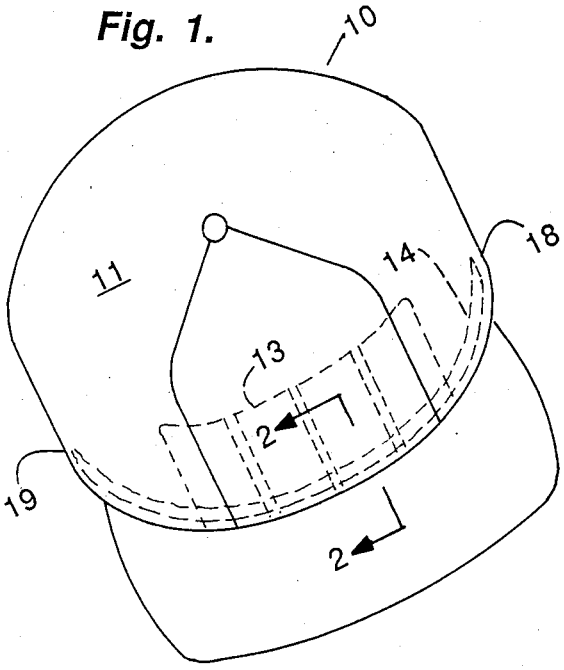
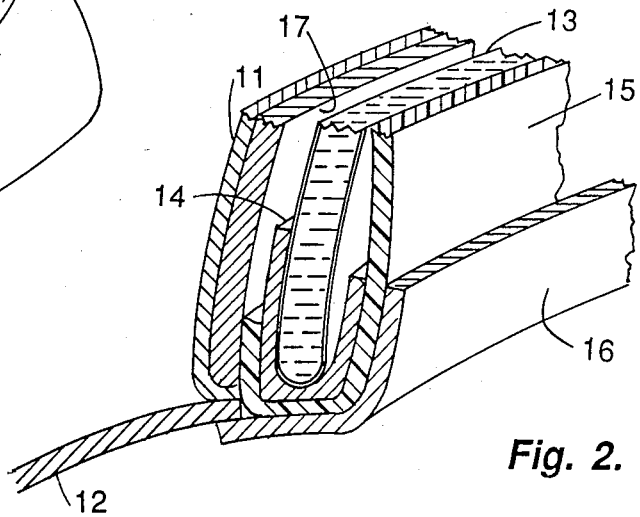
Fig. 2.
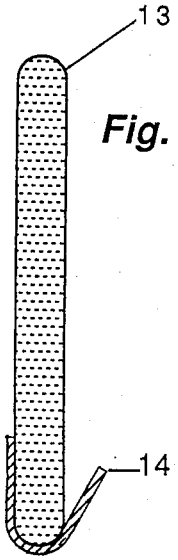
Fig. 4.
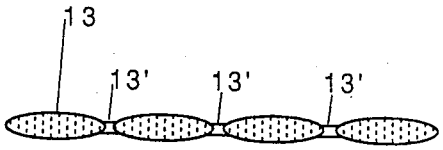
Fig. 5.
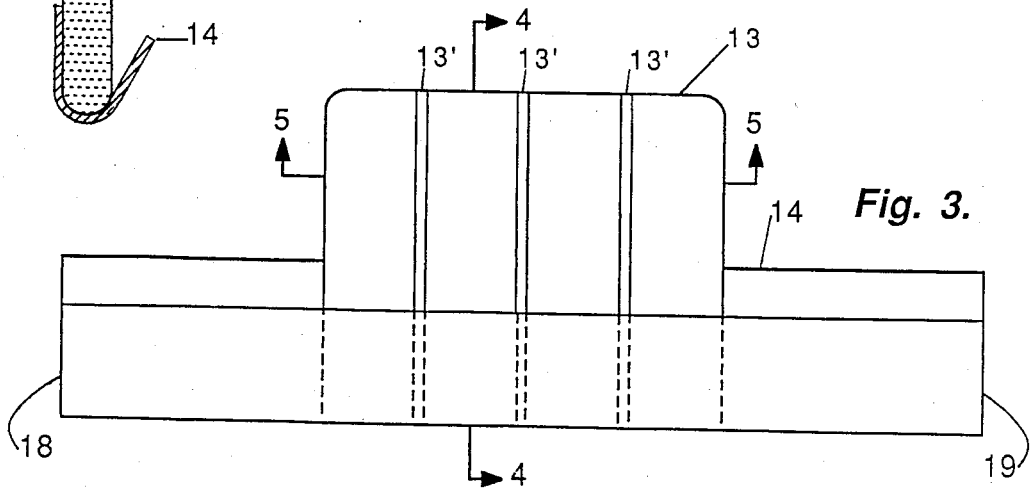
Fig. 3.

COOLED HEADWEAR

BACKGROUND OF THE INVENTION

This invention relates to headwear which includes a cooling element to prevent overheating of the wearer. In my copending application, Ser. No. 035,227, I have described a cap which utilizes a pre cooled pouch containing a liquid or gel as an insert in the forehead area to provide cooling for the wearer. I have noticed that under conditions of high humidity, moisture tends to condense on the cooled pouch, and may run down the pouch and drip. The present invention is intended to obviate this possible problem, and to improve the cooling effect of the cooling pouch.

SUMMARY OF THE INVENTION

As noted in the previous section, condensate forming on the cooling pouch of a cap provided with such means can flow downward and drip. The present invention provides a drain channel which retains and conducts condensate away from the cooling pouch. As the condensate flows along the channel it provides additional cooling to the temple area. An additional improvement is the segmenting of the pouch so that it will better conform to the shape of the wearer's head.

DESCRIPTION OF THE DRAWINGS

FIG. 1 is a perspective view of a cap which includes the invented improvement.

FIG. 2 is a partial cross section taken at 2-2 of FIG. 1.

FIG. 3 is developed view of the drain channel and segmented cooling pouch of the present invention.

FIG. 4 is a cross sectional view taken of 4-4 of FIG. 3.

FIG. 5 is a cross sectinal view taken at 5-5 of FIG. 3.

DETAILED DESCRIPTION OF THE INVENTION

FIG. 1 shows a cap which embodies the present invention. The cap as shown has a crown 11 and a bill 12. Shown dotted in FIG. 1 are the positions of a coolant pouch 13 and drain channel 14. The construction of these elements may be better seen in FIGS. 3–5.

The coolant pouch 13 is filled with a liquid or gel having a relatively high heat of fusion. When frozen, it provides a long lasting heat sink which will keep the cap wearer comfortable for several hours. My copending application Ser. No. 035,227 describes the cooling pouch in greater detail and the disclosure of that application is included herein by reference. The cooling pouch 13 as can be seen in the cross sectional view of FIG. 5 is preferably segmented at several places 13' so that the pouch can easily be made to conform to the shape of a user's head. The segmentation is easily accomplished by seaming the plastic pouch along several lines using heat, as is well known in the art.

The coolant pouch is retained in a pocket 15 which can be seen in FIG. 2. Pocket 15 is preferably made of fabric which has a water resistant coating on the inside face, i.e. the face in contact with pouch 13. Headband 16 encircles the entire interior of the crown, as is usual in cap construction. A foam pad 17 is fastened to the crown 11 in the area of the coolant pouch. Pad 17 serves to insulate the pouch from exterior heat, reducing the heat gain and thereby extending the time of effectiveness of the cooling function. The face of pad 17 in contact with pouch 13 preferably has a moisture impervious surface.

The drip channel 14 is formed of a folded strip of plastic and set in or sewn between headband 16 and crown 11. It preferably extends at least about half way around the circumference of the cap, as illustrated in FIG. 1. If desired, the drain channel can extend for any desired length, including completely around the circumference. The ends 18, and 19 are sealed so that the liquid in the channel will be trapped and not leak out.

FIGS. 3 and 4 illustrate the construction of the drain channel and cooling pouch, and show their relationship. Moisture condensing on the pouch 13 will run down the surface of the pouch and into the drain channel 14 where it is retained until at some later time it may be wiped out for purposes of cleanliness. The condensate as it enters the drain channel has been cooled by the pouch 13 so that as it flows along the side of the head it provides some small additional cooling effect.

While the present invention has been described in connection with a billed cap, those skilled in the art will realize that the invention is also applicable to other types of headwear, including even topless visors and skullcaps. Such other embodiments of the invention are intended to be included in the spirit of the following claims.

I claim:

1. In an article of headwear having an inner headband and including a precooled pouch within the headwear, the improvement which comprises a drain channel comprised of a folded plastic strip $B^1$ a length greater than the width of said cooling pouch, said drain channel being disposed within the headband of said headwear said drain channel being so constructed and arranged as to have one of the legs of said channel adjacent the wearer's forehead.

2. The improvement as recited in claim 1 where said drain channel extends to at least the temple area on each side of said headwear.

3. The improvement as recited in claim 1 wherein said cooling pouch is segmented

* * * * *